US008984676B2

(12) United States Patent
Zheng

(10) Patent No.: US 8,984,676 B2
(45) Date of Patent: Mar. 24, 2015

(54) TOILET WITH AN ODOR ELIMINATING FUNCTION

(71) Applicant: Yuan Guang Zheng, San Francisco, CA (US)

(72) Inventor: Yuan Guang Zheng, San Francisco, CA (US)

( * ) Notice: Subject to any disclaimer, the term of this patent is extended or adjusted under 35 U.S.C. 154(b) by 110 days.

(21) Appl. No.: 13/958,396

(22) Filed: Aug. 2, 2013

(65) Prior Publication Data

US 2014/0338114 A1 Nov. 20, 2014

(30) Foreign Application Priority Data

May 20, 2013 (CN) ..... 2013 2 0275939 U

(51) Int. Cl.
*E03D 9/05* (2006.01)
*E03D 9/052* (2006.01)

(52) U.S. Cl.
CPC ..... *E03D 9/052* (2013.01)
USPC ..... 4/348; 4/213; 4/216; 4/219; 4/352

(58) Field of Classification Search
USPC ..... 4/347, 348, 350–352, 213, 216, 219
See application file for complete search history.

(56) References Cited

U.S. PATENT DOCUMENTS 3,273,170 A * 9/1966 Wheeler ..... 4/348
8,151,377 B2 * 4/2012 Pickle ..... 4/213

* cited by examiner

*Primary Examiner* — Tuan N Nguyen
(74) *Attorney, Agent, or Firm* — Pro-TECHTOR International Services; Ian B. Oglesby

(57) ABSTRACT

An odor eliminating toilet with an air passage and enclosed ventilating fan is disclosed. Odors are removed from the toilet bowl during use by an air passage connecting the toilet bowl with the sewer outflow. The air passage contains a ventilating fan for removing said odors.

15 Claims, 3 Drawing Sheets

TOILET WITH AN ODOR ELIMINATING FUNCTION

FIELD OF THE INVENTION

The invention described below relates to a toilet system for the purpose of removing obnoxious odors promptly from the toilet bowl during toilet usage. More specifically, the subject invention pertains to ventilated toilet utilizing a ventilating fan to evacuate odors from a toilet bowl to the drain.

BACKGROUND OF THE INVENTION

A common problem with the traditional toilet is that odors accumulate during use and persist for a long time after the toilet usage. The conventional bathroom ventilating fan provided on the ceiling can not withdraw these odors promptly, efficiently and timely. There are many types of devices have been made to provide means for removing these obnoxious odors. They can be categorized into several groups according to their construction and mode of operation.

One set of devices use the ventilation system attached to the seat, or built into the seat itself. These ventilation systems can cause a sanitary problem due to the presence of baffles, channels and openings along the underside of the seat and/or tubing located in the bowl which presents a breeding ground for bacteria.

Another set of devices use an air filter system that is attached to the toilet bowl or hung on the side thereof. These designs involve the costs of buying and replacing filters. Furthermore, if the filter is spent, the system will pump unfiltered odor-filled air into the room.

Another set of devices use a pump system for removing odors from a toilet bowl to outside of the lavatory. Typically, the odors are pumped to the exterior of the bathroom or the building. These solutions require architectural improvements to be made to the building to allow for passages through which to pump the odor-filled gas.

In general, the above, ventilation systems have one or more of the following problems: inadequate sanitation, unsightly appearance, physical obstruction, and/or expense for the filter.

SUMMARY OF INVENTION

It is accordingly an object of the invention to provide an integral toilet having a pre-cast air channel for removing odors from a toilet bowl by pumping the odors to the sewer pipe, which overcomes the above-mentioned disadvantages of the heretofore-known devices and methods.

The basic features of present invention consist of four sections, an integral toilet having built in air channel and maintenance window, an odor or gases ventilating device, an annular eliminating device and air chamber enclosure elements.

In the first section, the air tunnel is set outside of the toilet bowl as one piece and has one top open end pass through the bowl wall forming an inlet opening; the other lower open end of the air tunnel, an outlet opening, connects to and passes through an air chamber which is provided under the front end of toilet bowl. The intake opening is further covered and waterproof sealed by an inlet screen to prevent solid waste get into the air channel. An open maintenance window is provided in the front wall of the toilet system and is provided for the purposes to repair or replace the ventilating parts when service is required.

The section of odor ventilating device includes a connector, a one-way valve and a low voltage direct current ventilating fan or similar device. The connector connects the aforementioned outlet opening and the ventilating fan. The ventilating fan sits inside the air chamber. The one-way valve can be installed either on the inlet of the fan or on the exhaust exit of said fan. The fan will collect the odors and keep the odors inside the an chamber during its operation.

The third section of the annular eliminating device is a thin and hollow plate and has its downward ring-like air outlet leading to the sewer pipe. The annular eliminating device sits under the toilet bottom outlet, and its horizontal air inlet connected with the air chamber.

The forth section of the present invention are two enclosure elements used to enclose the air chamber. One of the enclosure elements is a bottom plate to seal all the bottom area of the air chamber. The other enclosure element is a maintenance window cover, which is used to cover the maintenance window and the cover can be removed as needed. The air chamber is an airtight space to prevent the odor leak during the operation.

The main object of this invention is to provide a toilet bowl venting system whereby odors from within the toilet bowl may be vented therefrom and discharged into the drain line for the toilet bowl.

Another object of this invention in accordance with the preceding objects is to provide a toilet bowl venting system which will exclude the possibility of backflow of odors from the toilet drain line into the toilet bowl.

Still another object of this invention is to provide a toilet bowl venting system in accordance with the preceding objects and which may be easily accessible while maintenance and services are needed.

A final object of this invention to be specifically enumerated herein is to provide a toilet bowl odor venting system in accordance with the preceding objects and which will be economically feasible, long lasting and relatively trouble free in operation.

The construction and method of operation of the invention, however, together with additional objects and advantages thereof will be best understood from the following description of specific embodiments when read in connection with the accompanying drawings.

DETAILED DESCRIPTION OF THE PREFERRED EMBODIMENTS

Figure 1:
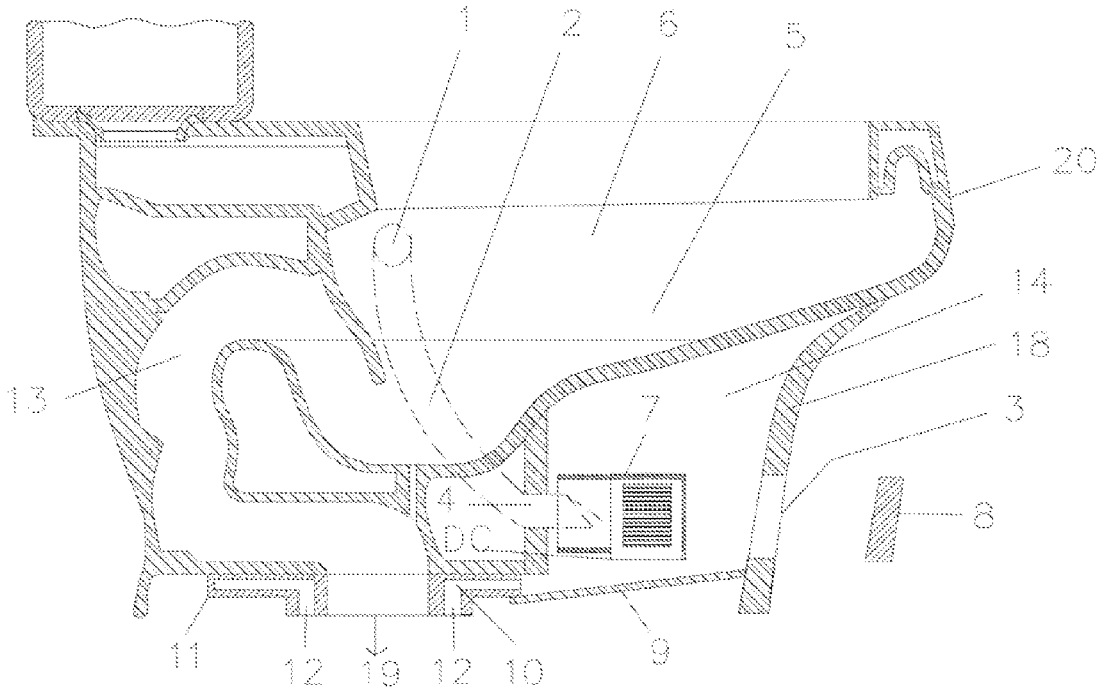
FIG. 1 is a sectional view through a toilet with an odors eliminating function according to the invention.
Figure 2:
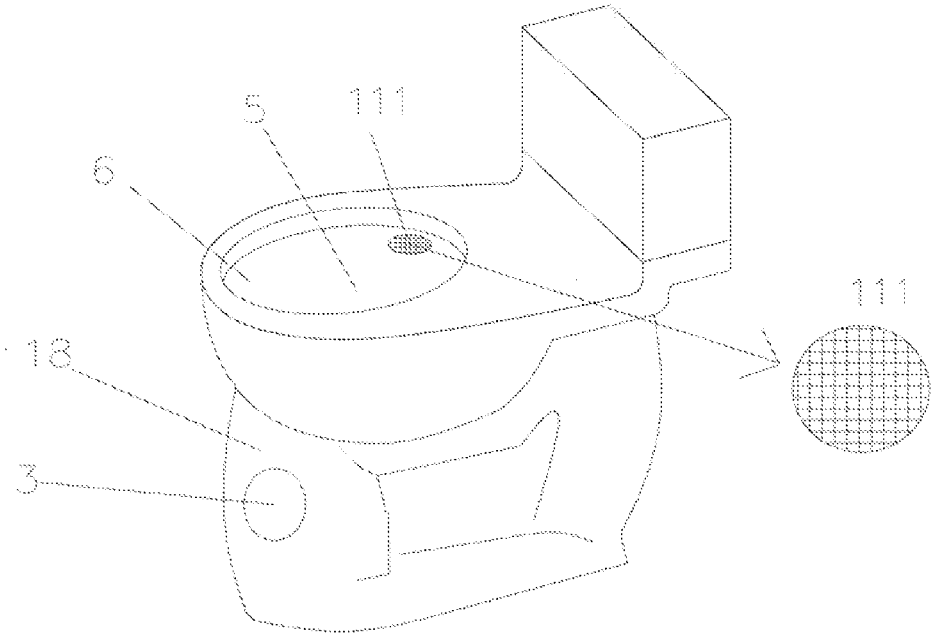
FIG. 2 is a diagrammatic view of a toilet prepared for assembly of the invention.

Referring now to the figures of the drawing in detail and first, particularly, to FIGS. 1 and 2 thereof, there is seen a toilet 20 that has been pre-casted for installing an air tunnel 2 for removing odors from a toilet bowl 5. The toilet 20 is a conventional toilet with an integrated body having the bowl or commode 5 with a discharge passage 13.

The air tunnel 2 is pre-set outside of the toilet howl 5 as one piece and has one top open end passed through the upper part of bowl wall 6 forms an inlet opening 1; the other lower open end of the air tunnel 2 is an outlet opening 4, which connects to and passes through an air chamber 14 which is provided behind front end wall 18 and under the front part of said toilet bowl 5. The intake opening 1 is further covered and waterproof sealed by an inlet screen 111 to prevent solid waste get into the air channel 2. The inlet screen 111 can be made by any durable waterproof materials. An open maintenance window 3 is provided in the front end wall 18 of the toilet 20. Said maintenance window 3 is provided for the purposes to repair or replace the ventilating parts when service is required.

Figure 3:
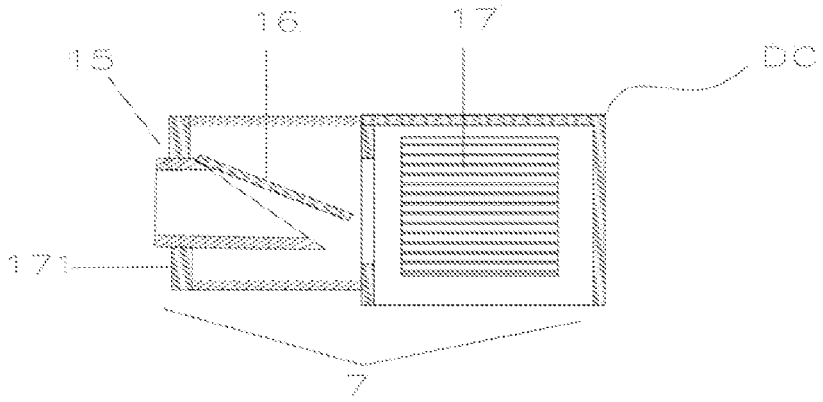
FIG. 3 is a diagrammatic view of a ventilating device according to the invention.

FIG. 3 illustrates an odor ventilating device 7 that is provided inside of the air chamber 14 (FIG. 1). The odor ventilating device 7 further consists of an inlet connector 15, a one-way valve 16, a fan connector 171 and a low voltage ventilating fan 17 or similar device. The ventilating fan 17 can be a centrifugal fan or a non-centrifugal fan. The ventilating fan 17 can be activated on and off by an electric switch (not shown). The inlet connector 15 connects the aforementioned outlet opening 4 and the fan connector 171 which then connecting to the ventilating fan 17. The ventilating fan 17 sits inside the air chamber 14 (FIG. 1). When the ventilating fan 17 starts to suck the odors from the toilet bowl 5, the one-way valve 16 will be pushed open. The one-way valve 16 will be closed when the ventilating fan 17 stops, that will prevent gases or odors returning back to toilet bowl 5. The one-way valve 16 can be installed either on the inlet of the fan or on the exhaust exit of said ventilating fan 17. The ventilating fan 17 will collect the odors and keep the odors temperately inside the air chamber 14 during its operation.

Figure 4:
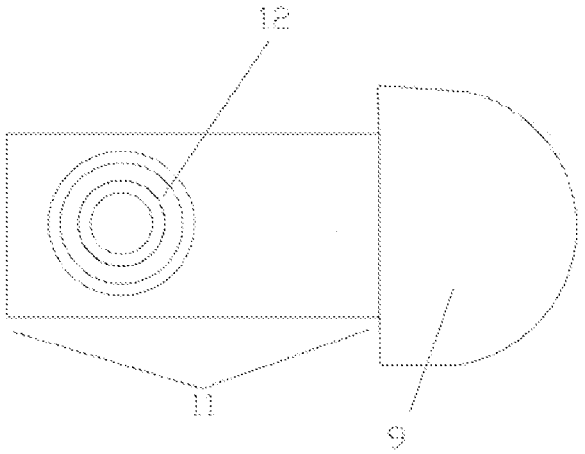
FIG. 4 is a bottom perspective view of an annular eliminating device and relation with a bottom plate according to the invention.
Figure 5:
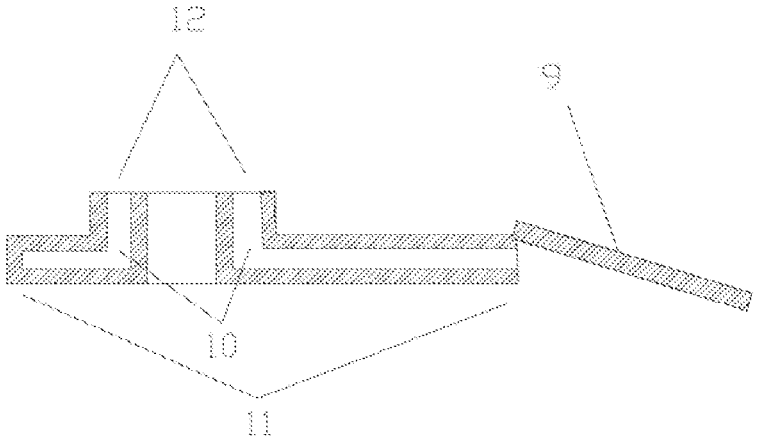
FIG. 5 is a sectional view of an annular eliminating device and relation with a bottom plate according to the invention.
Figure 6:
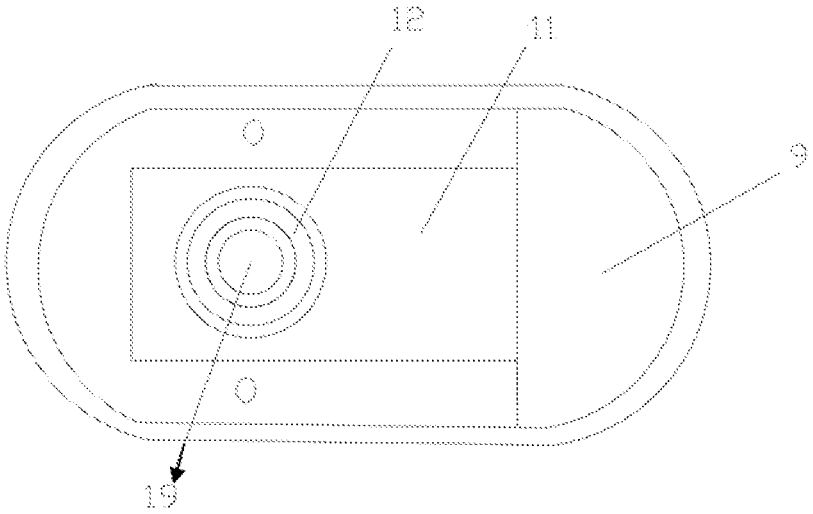
FIG. 6 is a bottom view of a toilet with odors eliminating function according to the invention.
Figure 7:
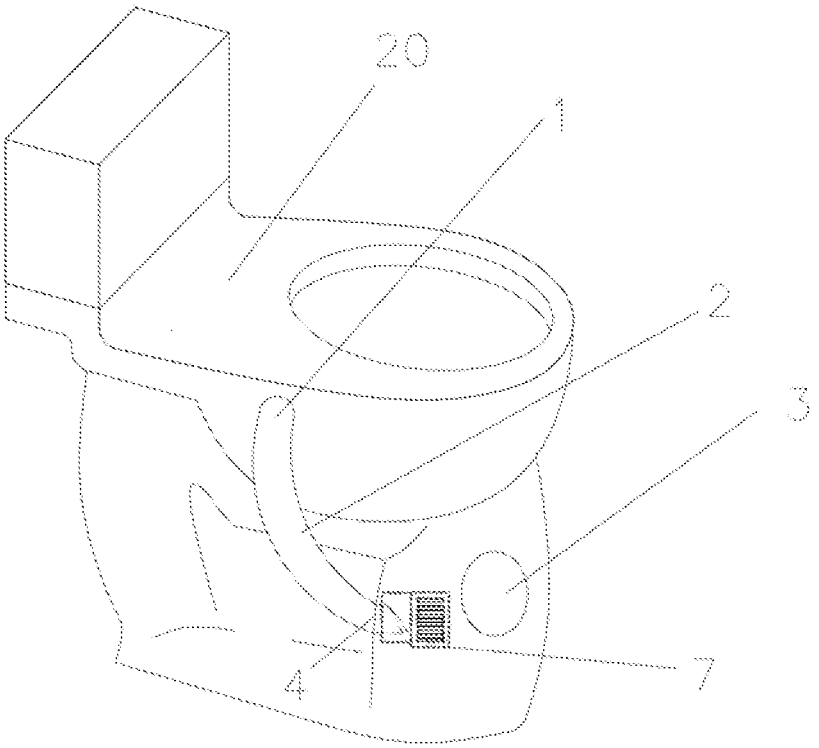
FIG. 7 is a front top perspective view of a toilet with odors eliminating function according to the invention.

Referring to FIGS. 4, 5 and 6, an annular eliminating device 11 is a thin and hollow plate and has its downward ring-like air vent 12 leading to the floor drain pipe 19. There is an air passage 10 provided inside the annular eliminating device 11. The annular eliminating device 11 is placed under the end of the discharge passage 13, with its hollow center aligned with the end of the discharge passage 13. The horizontal air passage 11 is opened toward the air chamber 14. The annular eliminating device 11 can be provided either during the toilet manufacturing process as a united part of the toilet 20 or as an independent element.

As illustrated by relevant drawing figures, there are two enclosure elements used to enclose the air chamber 14. One of the enclosure elements is a bottom plate 9 to seal all the bottom area of the air chamber 14. One end of the bottom plate 9 is placed on edge of the horizontal air passage 10 keeping the opening of air passage 10 enclosed inside the air chamber 14. All other edges are sealed under the air chamber 14 of the toilet 20. A maintenance window cover 8, which is used to air tightly cover the maintenance window 3 and the matching maintenance cover 8 can be easily removed as needed. The air chamber 14 is an airtight space to prevent the odor leak during the operation of the fan 17 or usage of the toilet 20.

After installation of the entire toilet 1 described above, when a user turn on the ventilating fan 17, the one-way valve 16 opens and the odors in the toilet bowl 5 are sucked from inlet opening 1 through the air tunnel 2 and the outlet opening 4 and into the air chamber 14, finally the odors are eliminated into the drain pipe 19 through the air passage 10 and the air vent 12.

With respect to the above description then, it is to be realized that the optimum dimensional relationships for the parts of the toilet with an odors eliminating function, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Further, since numerous modifications and changes will readily occur to those skilled in the art, it is not desired to limit the toilet ventilation apparatus to the exact construction and operation shown and described, and accordingly, all suitable modifications and equivalents may be resorted to, falling within the scope of the toilet with an odors eliminating function

What is claimed is:

1. A toilet with an odors eliminating function comprising:

a toilet having a toilet bowl with a discharge passage and a pre-cast air tunnel which is set outside of the toilet bowl;

a top open inlet opening of said tunnel passes through the upper part of said bowl wall and a lower open outlet opening of said air tunnel connects to and passes through an air chamber which is provided behind a front end wall of said toilet bowl;

an inlet screen covering the top open inlet opening;

a maintenance window in the front end wall of said toilet, said maintenance window comprising a matching, removable and air-tight maintenance window cover;

an odor ventilating device inside the air chamber, said ventilating device further comprising a inlet connector, a one-way valve, a fan connector and an electrical ventilating fan;

an annular eliminating device under and aligned with said discharge passage, which is a thin and hollow plate and has its downward ring-like air vent leading to the drain pipe;

an air passage inside said annular eliminating device opened toward the air chamber; and a bottom plate is to seal all the bottom area of the air chamber which is airtight space to prevent the odor leak during the operation or usage.

2. The toilet according to claim 1, wherein the inlet opening is provided on the upper part of bowl wall.

3. The toilet according to claim 1, wherein the inlet screen is made from durable waterproof materials.

4. The toilet according to claim 1, wherein the air tunnel is set inside or outside of the toilet bowl.

5. The toilet according to claim 1, wherein the air tunnel is set outside of the toilet bowl.

6. The toilet according to claim 1, wherein the air chamber is located behind the front end wall and under the toilet bowl.

7. The toilet according to claim 1, wherein the odor ventilating device is provided outside of the toilet.

8. The toilet according to claim 1, wherein the maintenance window cover and the bottom plate are made of durable waterproof materials.

9. The toilet according to claim 1, wherein the annular eliminating device is placed under the end of the discharge passage, and the annular eliminating device is made of durable waterproof materials.

10. The toilet according to claim 1, wherein the annular eliminating device is pre-cast during manufacture process.

11. The toilet according to claim 1, wherein the one-way valve is installed on the inlet of said ventilating fan.

12. The toilet according to claim 1, wherein the one-way valve is installed on the exhaust exit of said ventilating fan.

13. The toilet according to claim 1, wherein the ventilating fan is a centrifugal fan.

14. The toilet according to claim 1, wherein the annular eliminating device is provided during the toilet manufacturing process as a united part of the toilet.

15. The toilet according to claim 1, wherein the annular eliminating device is provided as an independent element.

* * * * *